United States Patent [19]

Okayasu

[11] Patent Number: 4,979,717

[45] Date of Patent: Dec. 25, 1990

[54] EASEL

[75] Inventor: Masayoshi Okayasu, Fuchu, Japan

[73] Assignee: Okayasu Gazai Inc., Tokyo, Japan

[21] Appl. No.: 487,714

[22] Filed: Mar. 2, 1990

[30] Foreign Application Priority Data

Mar. 2, 1989 [JP] Japan ..... 1-23049[U]

[51] Int. Cl.[5] ..... A47B 97/00

[52] U.S. Cl. ..... 248/449; 248/463

[58] Field of Search ..... 248/463, 448, 449, 464, 248/465

[56] References Cited

U.S. PATENT DOCUMENTS

| | | | |
|---|---|---|---|
| 292,086 | 1/1884 | Woodward | 248/449 |
| 410,191 | 9/1889 | Pluche | 248/449 |
| 440,225 | 11/1890 | Gardner | 248/449 |
| 486,549 | 11/1892 | Terslose | 248/449 |
| 2,019,214 | 10/1935 | Denny | 248/449 |
| 4,181,282 | 1/1980 | Oliver et al. | 248/448 |
| 4,260,124 | 4/1981 | Heilman | 248/449 |

FOREIGN PATENT DOCUMENTS

| | | | |
|---|---|---|---|
| 56-32124 | 7/1981 | Japan . | |
| 63-22901 | 6/1988 | Japan . | |
| 1-39472 | 11/1989 | Japan . | |
| 3214 | of 1888 | United Kingdom | 248/449 |
| 6071 | of 1889 | United Kingdom | 248/449 |
| 122156 | 1/1919 | United Kingdom | 248/449 |

*Primary Examiner*—David L. Talbott

*Attorney, Agent, or Firm*—Frishauf, Holtz, Goodman & Woodward

[57] ABSTRACT

A tripod easel with a pair of front legs that are held slightly wider apart at the foot than at the top includes a retaining mechanism for retaining a canvas holder in place which utilizes a portion of the weight of the holder itself or a portion of the sum weight of the canvas holder and the load thereon as the caulking force acting on the sides of the legs, thus providing an easy to use and secure mechanism for holding the canvas holder in place.

4 Claims, 3 Drawing Sheets

EASEL

BACKGROUND OF THE INVENTION AND RELATED ART STATEMENT

The present invention relates to an easel, and more particularly to an improved easel that can be suitably used for making sketches and studies.

Conventionally, simple tripod easels are extensively used for making rough sketches and studies for paintings and sculptures. Easels of this type usually comprise a pair of front legs that are held slightly wider apart at the foot than at the top in trapezoidal arrangement, a support backstay which is attached to the upper bar in a freely inclinable manner, and a canvas holder which is attached to the front of the legs, said support backstay being adjustable in its angle of opening so that the legs are inclined backward to allow the easel to stand on its feet.

In the prior art easel, the canvas holder may be held in place by means of a pair of support pins that are suitably inserted in holes bored at a given interval along the front of the legs in the longitudinal direction. Alternatively, caulking bolts and a plate are used to tightly sandwich and caulk the legs therebetween.

Use of support pins is defective in that they may inadvertently get lost when not in use or may become loose and come out of the holes when in use. Use of caulking means is also defective in that the canvas holder may tilt during use if the caulking forces applied on the legs are not well balanced. In the former case, ropes are often used to fasten the support pins and the legs, and in the latter case, it has been attempted to increase the friction coefficient of the legs that are to be sandwiched between the plate and the canvas holder. However, it still remains to be improved so that the user may be able to set the canvas holder at any desired height and to easily secure the same in place.

SUMMARY OF THE INVENTION

The present invention therefore aims at providing an improved easel which is characterized in that the canvas holder is held in place by a retaining mechanism which utilizes a portion of the weight of the canvas holder itself or a portion of the sum of said weight and the load thereon as the caulking force acting on the legs. This construction facilitates adjusting the height of the canvas holder and allows it to be secured in place.

Preferably, the retaining mechanism according to the present invention comprises one or more retaining metal strip members that are attached to the canvas holder in its longitudinal direction, an elongated hole which is formed in said strip member and has plural locking means, and a movable locking rod which is disposed in said sliding hole to engage with any one of the locking means by cam action and is provided with a retaining member that in turn engages with the side edge of the legs. If a knob is attached to the tip of the locking rod for manipulation, the height of the canvas holder can be adjusted with ease from the front of the easel.

THE PREFERRED EMBODIMENTS OF THE INVENTION

Figure 1:
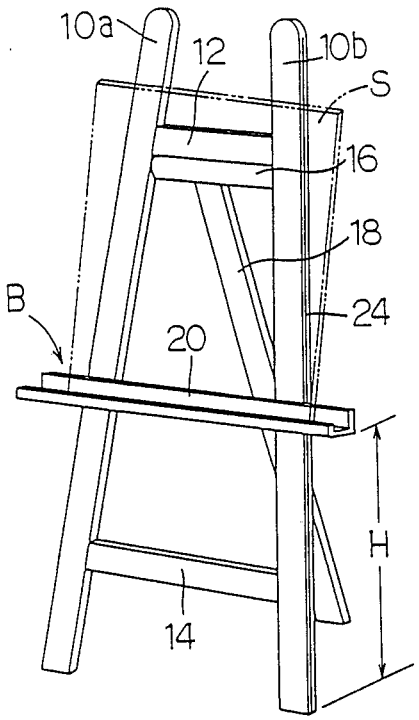
FIG. 1 is a perspective front view to show a preferred embodiment of the present invention easel.
Figure 2:
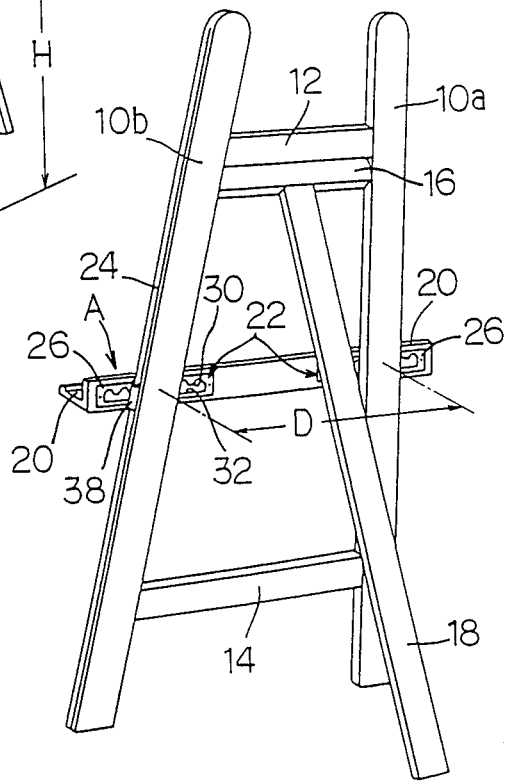
FIG. 2 is a perspective rear view of the embodiment in FIG. 1.
Figure 3:
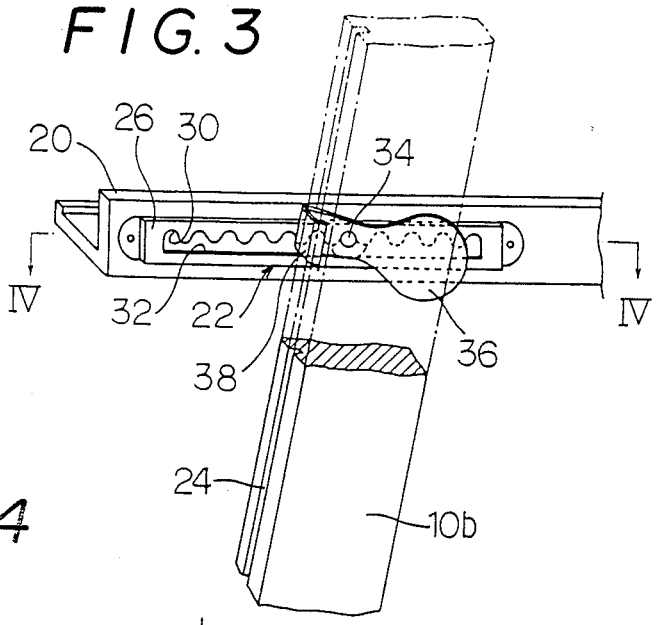
FIG. 3 is a partial perspective view of FIG. 2 at the portion A.
Figure 4:
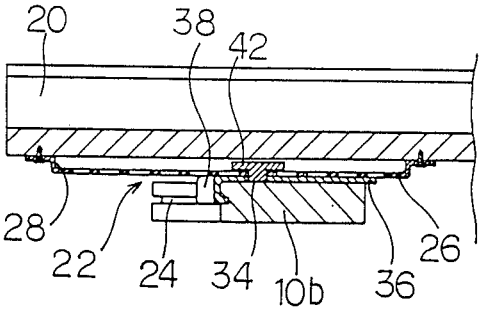
FIG. 4 is a cross sectional explanatory view of FIG. 3 along the line IV—IV.
Figure 5:
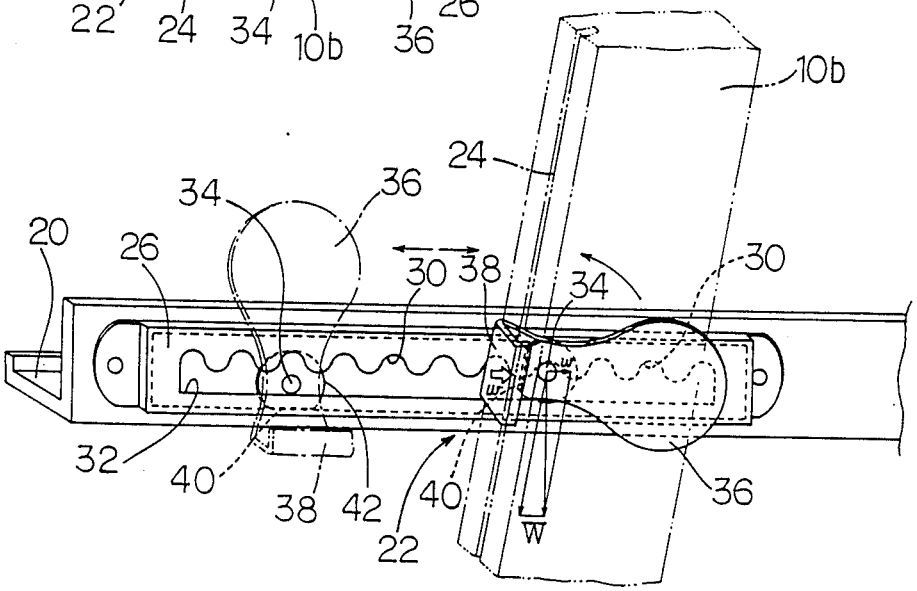
FIG. 5 is a view to explain the steps of manipulating the retaining mechanism shown in FIG. 3.

A preferred embodiment of the present invention will now be described in more detail referring to the attached drawings.

Referring to FIGS. 1 through 5, the easel according to the present invention includes a pair of front legs 10*a*, 10*b* of a predetermined length and made of wood such as oak. The legs 10*a*, 10*b* are connected by means of an upper bar 12 and a lower bar 14 with the lower portion slightly wider apart in a trapezoidal arrangement. A support member 16 is attached to the lower side of the upper bar 12 in a manner freely foldable with respect to the legs 10*a*, 10*b*. A support backstay 18 is fixed at its upper end to the support member 16.

A canvas holder 20 on which a canvas S will rest includes a retaining mechanism 22 which is provided one for each leg and is held in place at a desirable height against the legs 10*a*, 10*b* by one of the component parts of the mechanism 22 which engages with corresponding locking groove 24 formed on the outer side edge of each leg.

In other words, one such retaining mechanism 22 comprises a retaining metal strip member 26 that is attached to the back of the holder along its longitudinal direction at a given interval, said strip member 26 being bent on both sides to form a clearance 28 to be separated from the canvas holder, an elongated hole 32 with plural locking means 30, a locking rod 34 to be inserted in said elongated hole 32, a retaining member 36 which is formed like a shoehorn and fixed to the rod 34, and a guide claw 38 which engages with a locking groove 24 formed on the leg 10. A locking cam 42 having a flat end 40 is fixed to the other end of the rod 34. The locking cam 42 is so positioned that it causes the locking rod 34 to slide in the elongated hole 32 to be engaged with any one of the locking means 30 when the retaining member 36 is rotated (see FIG. 5).

It is noted that although the locking groove 24 is provided along the outer side edge of each leg 10*a* or 10*b*, the groove 24 may be omitted if said guide claw 38 is so formed to reach as far as the back of the leg.

In order to use the easel thus constructed, a user first opens the support backstay 18 at a suitable angle with respect to the legs 10*a*, 10*b* to stand the easel. By rotating the shoehorn-like retaining member 36 attached to each of the strip members 26 on the canvas holder 20, each locking rod 34 is slid into the elongated hole 32 (see the phantom line in FIG. 5) by the action of the locking cam 42 and moved for any suitable distance. Then, by rotating the shoehorn-like retaining member 36 again, the locking rod 34 is rested against a given locking means 30. The distance D between the rods 34, 34 is set substantially equal to the distance between the legs 10*a* and 10*b* which is determined by a desired height H of the canvas holder 20.

The canvas holder 20 is moved downward from a height slightly above said height H along the front of the legs 10*a*, 10*b* to cause each guide claw 38 to engage with the groove 24. As the canvas holder 20 is further pressed downward, a component of force 2 of the weight W of the canvas holder 20 acts a caulking or normal locking force w of the guide claws 38 on the grooves 24, 24 of the legs 10*a*, 10*b* because of the internal distance D between the locking rods 34, 34. In this manner, the canvas holder 20 is held at desired height H (see FIG. 5). When a canvas S or the like is placed on the canvas holder 20, its weight is added to the weight W of the canvas holder 20 to thereby increase the component w in the horizontal direction (caulking force w) for further secured connection.

To change the height H of the canvas holder 20, the user may simply another the canvas holder 20 upward to release the engagement between each guide claw 38 of the shoehorn-like retaining means 36 and the locking groove 24, rotate each member 36 to cause the rod to slip into any one of the locking means so that the distance between two rods corresponds to the distance between the legs 10*a*, 10*b*, which allows the canvas holder 20 to be positioned at the desired height. Then each guide claw 38 is slid in the groove 24 for engagement.

Although the retaining mechanism 22 has a pair of metal strip members 26, 26 in the above embodiment, it is also possible to attach one elongated retaining member 26 to receive in its elongated hole a pair of locking rods 34, 34, each provided with a shoehorn-like retaining member.

Figure 6:
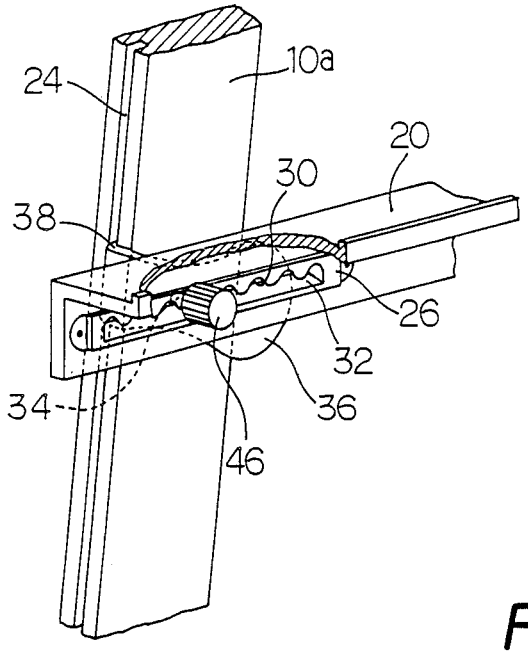
FIGS. 6 and 7 are partially exploded perspective views to show modifications of the embodiment shown in FIG. 1 at the portion B.

FIG. 6 shows another embodiment of the present invention. In this embodiment, each metal strip member 26 with the elongated hole 32 and the locking means 30 is attached to the canvas holder 20 at a position corresponding to a slit 44 formed on the canvas holder 20. The locking rod 34 is provided with a knob 46 which protrudes from the front edge of the canvas holder 20. By manipulating the knob 46, the retaining member can be rotated and the engagement between claw 38 and the groove 24 can be released. Thus, the user can easily and conveniently adjust the height of the canvas holder 20 from the front.

Figure 7:
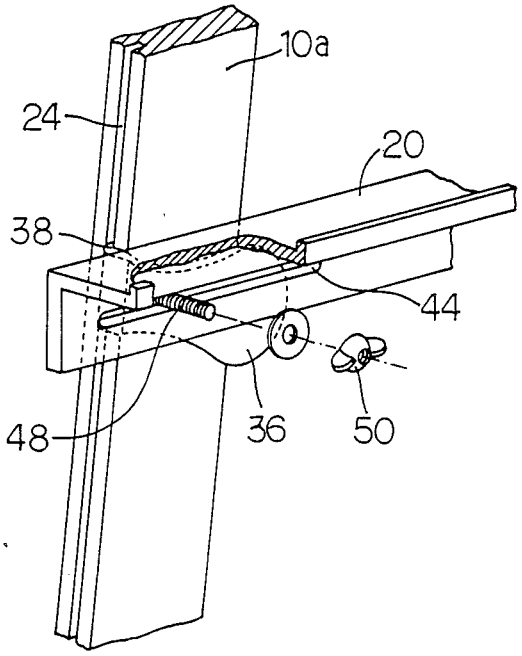

FIG. 7 shows still another embodiment wherein a retaining member 36 having a guide claw 38 each is attached to a bolt member 48, and the bolt member 48 is inserted in a slit 44 formed on the canvas holder 20 to be fastened by means of a butterfly nut 50. Like the embodiment shown in FIG. 6, this construction allows the user to adjust the height of the canvas holder from the front as well as offering a very simple structure.

As has been described in the foregoing, the easel according to the present invention is advantageous in that a portion of the weight of the canvas holder itself or a portion of the sum weight of the holder and its load can be utilized in tightly fastening the holder to the legs, to thereby enable the user to easily change the height of the canvas holder. It is further advantageous in that because of the simple structure, its cost of manufacture can be reduced, and that the caulking force acting on the legs increases with the heavier load on the canvas holder so that the canvas holder can be more firmly secured to the legs.

Although description has been made to the preferred embodiments of the present invention, it should be noted that the present invention is not limited to them. Various modifications in its design are possible without deviating from the spirit and scope of the present invention. For example, a pair of retaining members may be movably disposed in a single slit formed in a metal strip attached to the canvas holder, whereby the distance between the pair of retaining members may be adjusted by connecting these members with a string member which is adjustable in its length.

What is claimed is:

1. An easel comprising:

a pair of front legs defining a foot and a top of the easel;

bar means connected to the front legs for holding the legs wider apart at the foot than at the top;

an elongate canvas holder adapted to be supported at a desired position on a front face of said front legs;

support backstay means inclined to support the legs; and retaining means for holding said canvas holder in place at a front face of the front legs;

said retaining means including at least one retaining strip arranged in the longitudinal direction at a backside of the canvas holder which faces the front legs, an elongated slide hole being formed parallel to an upper edge of the retaining strip and defining plural locking means;

a locking rod inserted for movement in said elongated slide hole;

a cam member connected to said locking rod; and claw means connected to said locking rod for engaging an outer side of each front leg, wherein said locking rod is positioned at a given locking means along said retaining strip by action of said cam member so that a portion of the weight of the canvas holder or a portion of the sum of the weight of the canvas holder and a load acting thereon will act on the outer sides of the front legs as a horizontal locking force to hold the canvas holder in place.

2. An easel according to claim 1, wherein said bar means is arranged to hold said front legs slightly wider apart at the foot than at the top in a trapezoidal arrangement.

3. An easel according to claim 1, wherein each of said front legs has a locking groove formed on its outer side, and said claw means is formed to engage said locking groove.

4. An easel according to claim 1, wherein said canvas holder has a slit formed in its long direction, and said retaining strip is attached to the canvas holder at a position corresponding to said slit.

* * * * *